US006848527B2

(12) United States Patent
Nelson

(10) Patent No.: US 6,848,527 B2
(45) Date of Patent: Feb. 1, 2005

(54) MOTORIZED SKATEBOARD-TYPE VEHICLE

(76) Inventor: Lucas J. Nelson, 704 S. Story St., Rock Rapids, IA (US) 51246

( * ) Notice: Subject to any disclaimer, the term of this patent is extended or adjusted under 35 U.S.C. 154(b) by 13 days.

(21) Appl. No.: 10/266,837

(22) Filed: Oct. 8, 2002

(65) Prior Publication Data

US 2004/0065494 A1 Apr. 8, 2004

(51) Int. Cl.[7] ..... A63C 5/08
(52) U.S. Cl. ..... 180/181; 180/180; 280/87.042
(58) Field of Search ..... 180/180, 181, 180/182, 15, 16, 22, 6.54; 280/87.041, 87.042

(56) References Cited

U.S. PATENT DOCUMENTS 1,262,597 A * 4/1918 Englander ..... 180/15
1,355,853 A * 10/1920 Salvator ..... 180/6.54
3,630,540 A * 12/1971 Smith ..... 280/87.042
3,942,449 A * 3/1976 Nelson ..... 180/22
4,073,356 A 2/1978 Schlicht
4,373,738 A * 2/1983 Lange ..... 180/22
4,795,181 A 1/1989 Armstrong
5,381,870 A * 1/1995 Kaufman ..... 180/181
5,487,441 A 1/1996 Endo et al.
5,762,154 A * 6/1998 Hsu ..... 180/15
5,927,420 A 7/1999 Karrington
6,196,343 B1 * 3/2001 Strautnieks ..... 180/22
6,502,842 B2 * 1/2003 Ko ..... 180/15

* cited by examiner

*Primary Examiner*—Hau Phan
(74) *Attorney, Agent, or Firm*—McKee, Voorhees & Sease, P.L.C.

(57) ABSTRACT

A motorized skateboard or skateboard-like vehicle including a deck upon which the user can stand, fore and aft skateboard-like trucks and a drive wheel mounted intermediate the fore and aft trucks. A suspension allows a range of travel above the drive wheel relative to the deck. In one aspect, a biasing means biases the drive wheel away from the deck.

29 Claims, 6 Drawing Sheets

MOTORIZED SKATEBOARD-TYPE VEHICLE

I BACKGROUND OF THE INVENTION

A. Field of Invention

The present invention relates to a skateboard-type apparatus, and in particular, to a self-propelled skateboard-type apparatus.

B. Problems in the Art

Skateboards have been around for decades. Recently there has been a resurgence of the popularity of the skateboard. Also, snowboarding has recently been developed. It uses the same or similar types of athletic movement to control its direction of travel. The user stands on the top of the board and by shifting location of the user's feet and center of gravity tilts the board to cause direction change. In the case of many skateboards, what are called skateboard trucks allow the user to control the board in this manner. Skateboard trucks are usually front and back sets of wheels having the ability to both travel over a range up and down as well as pivot around a central pivot point forward and aft. Conventional skateboards and snowboards require either user propelling force or gravity to move.

Attempts have been made to develop motorized skateboards. Many mount the engine or motor at the rear or one end of the board and utilize a transmission or differential to mechanically transmit rotary power from the motor to a wheel or wheels of a skateboard truck. While these attempts try to provide self-propulsion for the skateboard, certain issues are created. For example, usually some type of rather complex mechanical linkage is required between motor and wheel because the wheel is beneath the board, in turns the wheel on one side turns at a different speed than on the other side, and the wheel is allowed both up and down and fore and aft movement. Sometimes it requires a transmission or differential. This adds cost and complexity to the device.

Furthermore, placement of motor or batteries at one end of the board can alter the center of gravity of the board. This can effect both the performance and "feel" of the board. It can important to maintain the performance and feel the non-motorized skateboard.

Still further, driving one of the wheels of the skateboard trucks can take away from the "feel" of the skateboard in the sense that the user feels he or she is being pushed or pulled. Driving one wheel can also make it difficult to maintain a straight heading with the board, and at higher speeds can create wobble or difficulty in control or direction. Moreover, driving one wheel of the wheel truck at one end of the board would not allow any smaller turning radius for the board.

Therefore, a need has been identified in the art for an improvement to motorized skateboards having motors at one end of the board with mechanical linkage to drive one or more of the wheels of the skateboard truck of the board.

Additional attempts to motorize skateboards that differ from what was previously described have been made. One example is Karrington U.S. Pat. No. 5,927,420. It utilizes a motor at one end of the board, but by chain drive drives a separate fifth-wheel positioned in the center of the board. One embodiment shows the fifth wheel behind the rear wheel truck. Another shows it near but slightly ahead of the rear wheel truck. In either case, the motor is at the back of the board. Thus, the center of balance of the board is effected. Also, a transmission, in the form of a chain drive, is needed for driving the fifth wheel.

Schlicht U.S. Pat. No. 4,073,356 and Endo, et al. U.S. Pat. No. 5,487,441 place a driven fifth wheel towards the middle of the board between opposite skateboard trucks. The engine or battery is also positioned mid-board.

However, in Schlicht, the driven fifth wheel is rigidly but rotatably mounted to the board. It relies on a built-in flexure of the board to move the drive wheel into engagement with the ground by utilizing the weight of the user, when mounting the board, to flex the board downward. When the user is off the board, the board flexes up to a normal state and lifts the wheel from the ground. This arrangement is problematic because it relies on the material properties of the board and the weight and position of the user to attempt to engage the drive wheel with the ground to propel the skateboard. Additionally, there would be a direct transmission of forces experienced by the drive wheel to the board. Especially on non-even terrain, it may be difficult for the wheel to follow the terrain in a manner that can maintain traction with the ground so that there are no interruptions in propulsion of the board.

Endo, et al. U.S. Pat. No. 5,487,441 uses an electrical motor with a battery and motor underneath the board. However, it relies upon a transmission combination to power the driven wheel. One embodiment drives one or more of the skateboard trucks and eliminates the fifth driven wheel. Another embodiment has only a front skateboard truck and one central, but rear driven wheel. It appears the design positions the fifth driven wheel such that is would always in the same plane as the bottom of the skateboard truck wheels, and thus theoretically always in contact with the ground. However, as previously mentioned, this does not provide for any independent movement relative to the board or to the other wheels and thus may not maintain contact if there is a depression in the terrain. It may also create difficulties for traction if there are protrusions or bumps.

Therefore, despite the various attempts at motorized skateboards, there is room for improvement in the art.

II. SUMMARY OF THE INVENTION

It is therefore the principal object, feature, or advantage of the present invention to provide a motorized skateboard, which improves over the state of the art.

Other objects, features and/or advantages of the present invention include a motorized skateboard, which:

a. is relatively non-complex and has relatively few moving parts;

b. promotes the center of gravity towards the middle of the skateboard;

c. promotes a smooth and controllable ride;

d. is economical to manufacture and maintain;

e. reduces wobble or pulling or pushing when propelled;

f. simulates the feel of a regular skateboard or snowboard;

g. can be adapted to operate over a variety of terrain;

h. can provide the advantage of a shorter turning radius than most conventional skateboards;

i. allows the drive system to be made relatively compact and does not necessarily require any mechanical link or geared transmission or differential;

j. is adjustable and flexible to adapt to a variety of conditions and desired modes of operation; and k. is robust and durable.

These and other objects, features, and/or advantages of the present invention will become more apparent with reference to the accompanying specification and claims.

In one aspect of the invention, a motorized skateboard-like vehicle comprises a skateboard deck with a pair of skateboard trucks at opposite ends. A drive wheel is positioned intermediate between the trucks. The wheel is rotatably connected to an arm or support member. The arm or support member is connected to the deck in a manner that allows displacement of the wheel relative to the deck. A shock-absorbing or biasing device can be connected between the arm and the deck to bias the drive wheel downward away from the deck and/or absorb forces experienced by the drive wheel. In this manner, the drive wheel can better follow the contours of the ground, even when the ground is not relatively flat or firm. The drive wheel has a range of movement relative to the plane of the skateboard trucks and relative to the deck to better attempt to follow the ground and maintain traction to propel the board. The skateboard trucks are relied upon for most of the support of the weight of the skateboard and the user relative to the ground. Thus, the "feel" of a regular skateboard and/or snowboard is promoted.

III. BRIEF DESCRIPTION OF THE DRAWINGS

Figure 1:
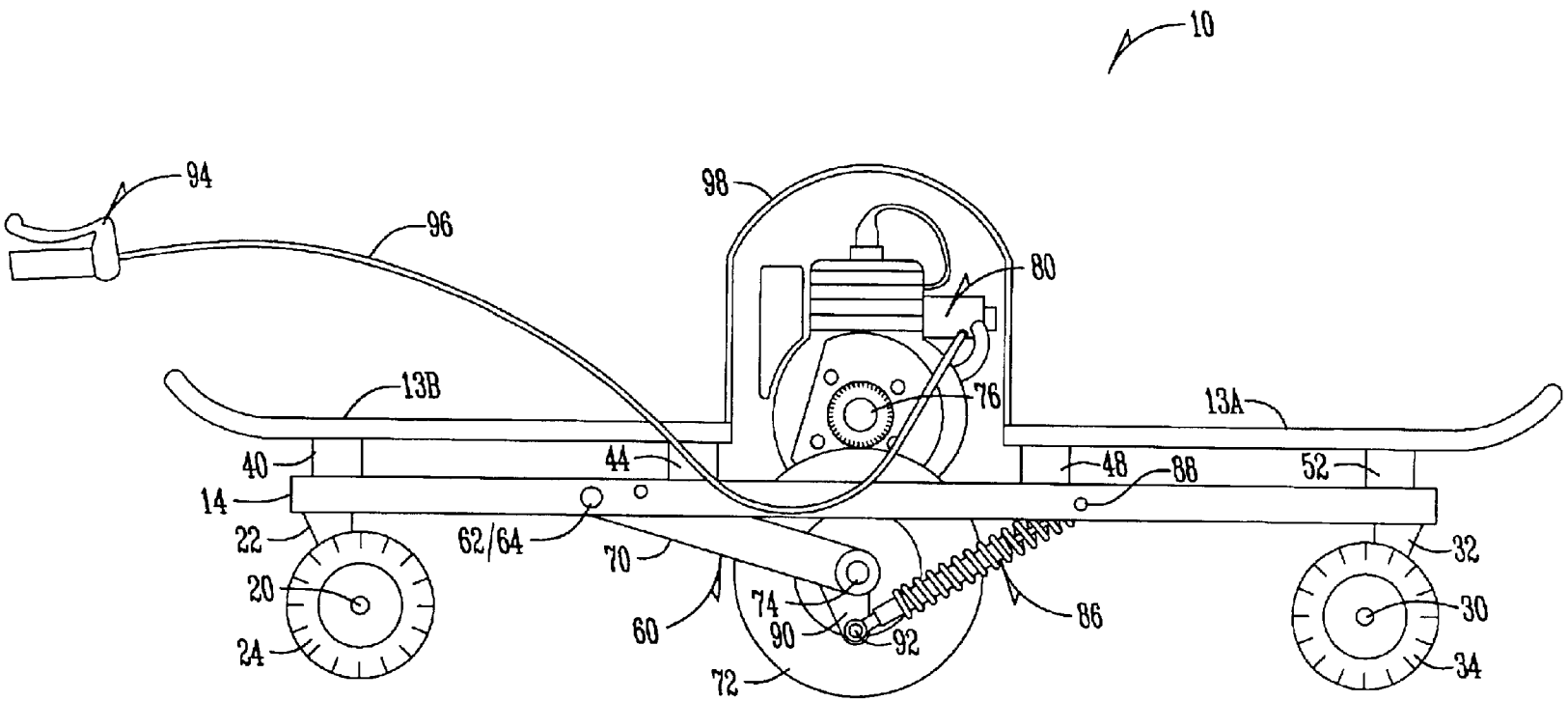
FIG. 1 is a side elevation view of an embodiment according the present invention, with a gas tank for the motor removed to better show how rotational power from the motor is transferred to the drive wheel.
Figure 7A:
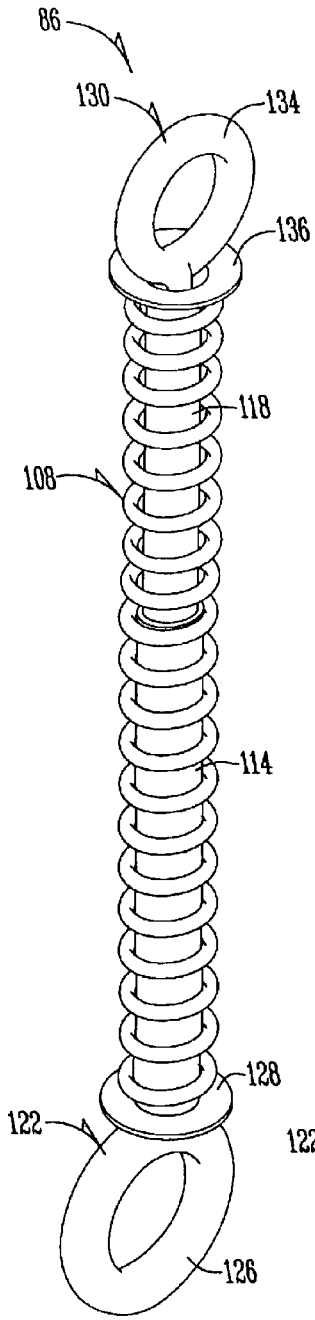
Figure 7B:
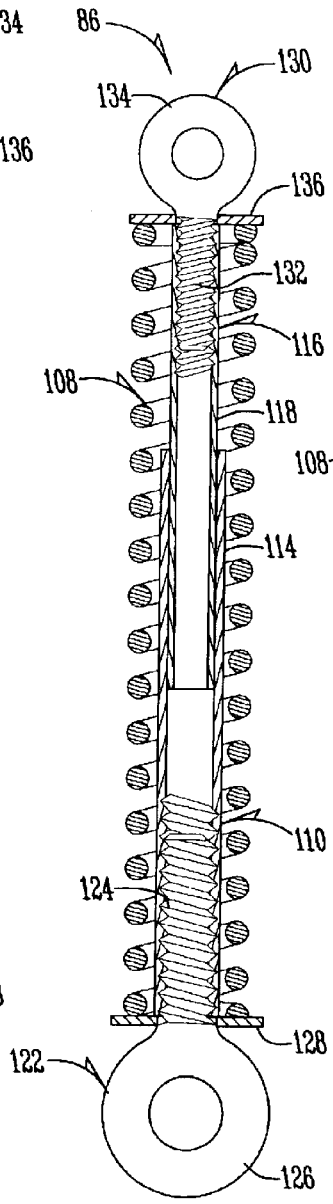
Figure 7C:
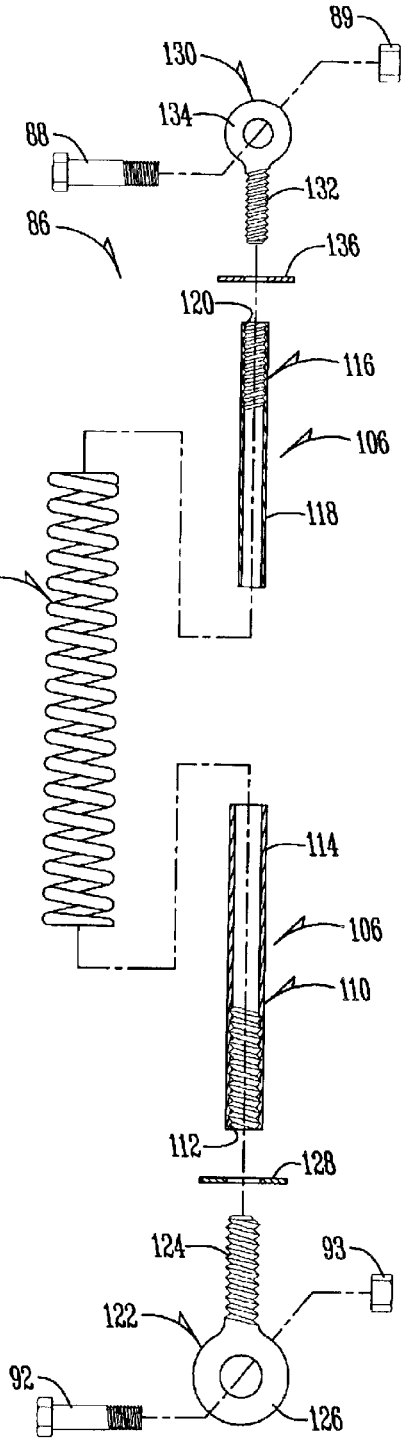

FIGS. 7A–C are assembled, assembled sectional, and exploded sectional views of a suspension member or biasing member that can be used for component 86 of FIG. 1.

IV. DETAILED DESCRIPTION OF AN EXEMPLARY EMBODIMENT OF THE INVENTION

A. Overview

In order to obtain a better understanding of the invention, one example of how the invention could be made and practiced is now described in detail. It is to be understood that this is but one example of the invention and not intended to limit the scope of the invention. Variations obvious to those skilled in the art will be included within the invention and this one example is presented for illustration and not limitation.

In this description frequent reference will be taken to the appended figures. Reference numerals and letters will be used to indicate certain parts or locations in the drawings. The same reference numeral or letters will be used to indicate the same parts or locations throughout all of the drawings unless otherwise indicated.

This exemplary embodiment will shown and described relative to a skateboard that is configured for use on a variety of terrain. In particular, it utilizes pneumatic tires for the wheels of the fore and aft skateboard trucks, oversized compared to regular, non-pneumatic, hard plastic skateboard wheels. However, the principals of the invention would apply to regular skateboard trucks and wheels or to other configurations.

Furthermore, the exemplary embodiment utilizes a separate framework underneath the skateboard deck. This lends increased rigidity and robustness to the skateboard, especially for "off-road" use. It is to be understood that, alternatively, the skateboard deck itself could function as both deck and framework for the skateboard, with trucks directly attached to the board such as shown in U.S. patents Schlicht U.S. Pat. No. 4,073,356, Karrington U.S. Pat. No. 5,927,420 or Endo et al. U.S. Pat. No. 5,487,441. Still further, the deck of the exemplary embodiment is actually split into fore and aft separated sections. Alternatively, it could be a unitary deck.

B. General Structure

Figure 2:
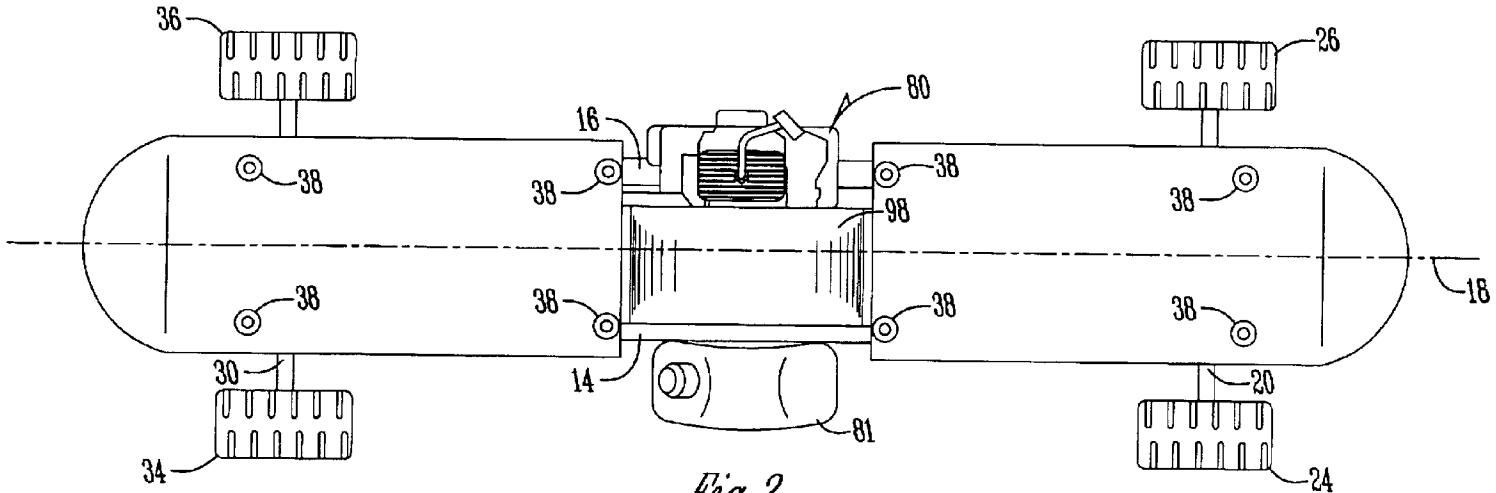
FIG. 2 is a top plan view of FIG. 1 with the gas tank in place.
Figure 3:
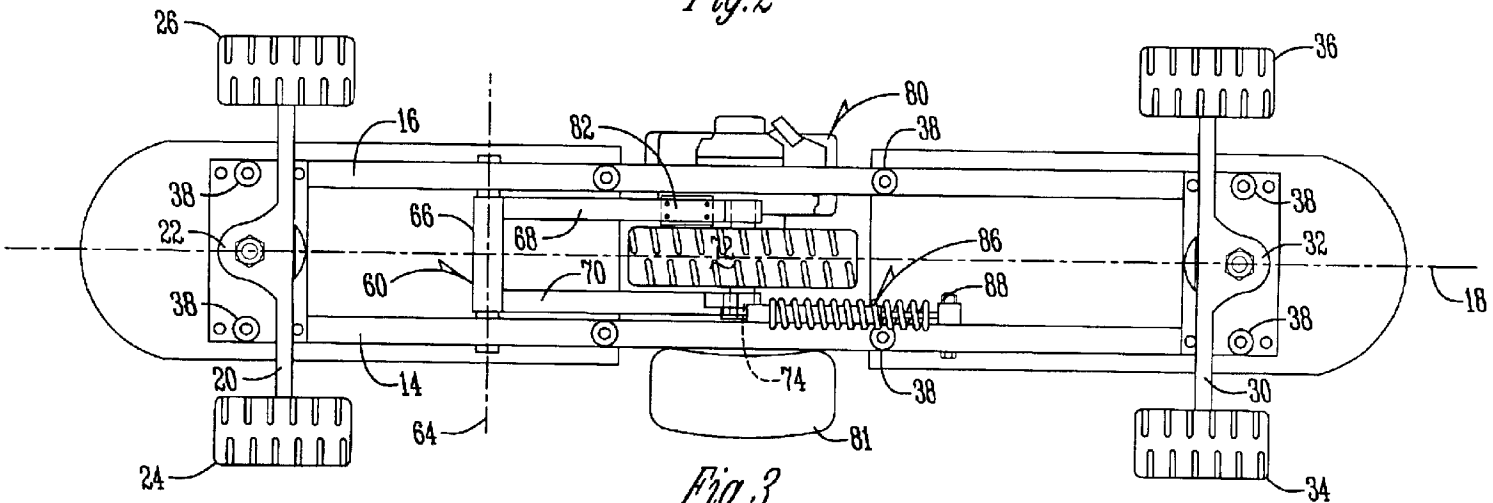
FIG. 3 is a bottom view of FIG. 2.

By referring to FIGS. 1–3, the general structural and operational components of the exemplary embodiment can be seen. The embodiment of FIGS. 1–3 will be generally referred to as skateboard 10. Its general dimensions can be on the order of 40" to 50" in length along its longitudinal axis 18, and 8" to 14" width for deck 13. The wheel base between fore and aft skateboard trucks 22 and 32 can be approximately 37". The distance between wheels 24 of each truck 22 and 32 is approx. 9".

As can be seen in FIG. 1, the deck 13 upon which the user stands is comprised of forward or fore deck section 13A and rear or aft deck section 13B. Sections 13A and 13B are supported on a frame (generally referred to as frame 12) by four pairs of deck mounts 40/42, 44/46, 48/50, and 52/54 which are connected by rivets, bolts, screws, or other connectors or connection methods to parallel frame rails 14 and 16 (See FIG. 3). Each rail 14 and 16 extends substantially underneath deck sections 13A and B on opposite sides of the longitudinal axis of skateboard 10.

Deck 13 can be made of any number of materials including wood, plastic, composite material, metal, or the like. Preferably, at least part of the top of deck 13 is covered with a non-slip surface or has a surface texture. Rails 14 and 16 can be solid or tubular metal (e.g. 1" square steel tube). The deck mounts can be made of metal or other materials including elastomeric or resilient materials such as rubber or polyurethane.

The skateboard trucks 22 and 32 are similar to those shown in the previously referenced Schlicht, Karrington, or Endo et al. patents. They are connected to frame rails 14 and 16 by screws, welding or other connections or connecting methods. An axle 20 or 30 is journaled in a manner that allows it to pivot in a plane orthogonal to longitudinal axis 18 of skateboard 10, in a plane parallel to the plane of deck 13, and in a variety of planes therebetween. This is standard skateboard truck functioning.

In this exemplary embodiment, wheels 26 and 36 are oversized and pneumatic to better absorb shock and function in off-road terrain such as dirt, grass, gravel, etc., as opposed to hard surfaced roads or sidewalks.

Therefore, the above-described structure functions basically as a conventional skateboard. The user can adjust his or her center of gravity and position to tilt deck 13 while the skateboard trucks support the users weight on the ground. Steering and control of direction of the skateboard is therefore like conventional skateboards and similar to the movements needed to control direction of a snowboard.

Components allowing self-propulsion of skateboard 10 include a fifth or drive wheel 72, pneumatic and of larger diameter than wheels 24 or 34, and mounted on a hub which is rotatably mounted to an axle 74 that is traverse to longitudinal axis 18 of skateboard 10. Axle 74 is fixed in the distal end of a swing arm 60. The proximal end of swing arm 60 is rotatable around axis 64 (see FIG. 3) defined by pivot axle 62, which is fixed at opposite ends in frame rails 14 and 16.

Swing arm 60 includes a base 66 rotatable about axle 62 and opposite parallel arms 68 and 70 that extend out to axle 74 for wheel 72. Gasoline engine 80 is mounted at mount 82 to the top of arm 68 of swing arm 60 and extends upwardly. Drive spindle 76, which rotates when engine 80 is operated, is in frictional contact with the exterior perimeter of drive wheel 72. Motor mount 82 has adjustment capability to adjust the relationship of spindle 76 to the exterior or tread of wheel 72 for appropriate frictional engagement and/or for different sized diameter spindles or diameters of drive wheel 72. As shown in FIGS. 2 and 3, a gas tank and other structure are operatively connected to engine 80.

One example of an engine 80 is a 1¼ hp, 2-cycle, gasoline engine. Such an engine could be similar to those that could be purchased off the shelf for such things as ice augurs. A variety of types of such engines are commercially available. Such an engine is relatively compact and has sufficient torque for skateboard 10. The diameter of spindle 76 can be selected for a desired driving characteristic. For example, according to well-known principles, the larger the diameter of the spindle, the more power can be transmitted to drive wheel 72. The smaller the diameter of spindle 76, the more speed that can be produced from drive wheel 72. The exterior of spindle 76 can be textured or machined, or could be smooth.

Engine 80 can be electric start or pull start and can have throttle control 94 pivotally connected to a cable 96 that allows the user of skateboard 10 to hold throttle control 94 in his or her hand while standing on skateboard 10.

The shock absorber 86 is connected between frame rail 14 at pivot connection 88 and flange 90 of swing arm 60 at pivot connection 92. Shock absorber 86 can be a standard tension spring arrangement which tries to bias end 92 away from end 88 when connected to frame rail 14. Flange 90 is rigidly connected to arm 70 of swing arm 60. Thus the shock absorber 86 functions both to bias wheel 72 down and away from frame and deck 12/13, but also absorb and resist forces that try to push drive wheel 72 upwards towards frame and deck 12/13.

The range of vertical travel of wheel 72 is approximately 4". The bottom of the range would have the bottom of drive wheel 72 an inch or more below plane defined by the bottom of the wheels of trucks 22 and 32. The top of the range would be several inches above the plane of the bottom of trucks 22 and 32.

Shock absorber 86 could be purchased off the shelf (similar or same as car or truck shock absorber). Others are, of course, possible. Additionally, other apparatus or methods of biasing drive wheel 72 and providing shock absorption are possible.

In one embodiment, spring 108 is helical or coil spring made of ¼" cross sectional diameter steel and with a 1" I.D. (inside diameter) and 1½" OD (outside diameter). Approximately 45 lbs. of pressure is required to compress the spring one-inch. Other materials, dimensions, and spring characteristics can be used depending on design choice and desired function.

In the exemplary embodiment, it can be seen that motor 80 and its gas tank 81 stand above the surface deck 13 and slightly outside the lateral boundaries of deck 13. Also, as can be appreciated, engine 80 is mounted on and travels with swing arm 60 as it pivots about pivot axis 64. Therefore, movement of drive wheel 72 relative to deck 13 also involves corresponding movement of engine 80, gas tank 81, and other operational components of engine 30. The open area between split fore and aft sections 13A and 13B of deck 13 accommodates placement of engine 80 and gas tank 81 in the middle of deck 13 and as close to longitudinal axis 18 of skateboard 10 as possible. Drive wheel 72 is aligned essentially along longitudinal axis 18.

To provide some protection against contact with engine 80, a shroud 98 is positioned as shown. Sufficient space exists inside shroud 98 to allow movement of engine 80 and gas tank 81 with drive wheel 72 without contact with shroud 98.

Skateboard 10, in the exemplary embodiment, weighs between 35 and 40 pounds. It can be used for recreation, on road or off-road, transportation, or other sport.

C. Operation

To operate skateboard 10, the user mounts deck 13 like a traditional skateboard. The user grabs throttle control 96 and starts engine 80. The user increases throttle through throttle control 94 to the point of providing sufficient power to spindle 76 to rotate. Frictional engagement with drive wheel 72 would then rotate drive wheel 72 in an opposite direction. The biasing of shock absorber 86 biases drive wheel 72 to the ground to provide traction to propel the skateboard in a forward direction. Increase in throttle would increase speed of skateboard 10. The user would then shift or adjust his/her center of gravity and/or position to tilt deck 13 to steer skateboard 10, as with a conventional skateboard.

Figure 4:
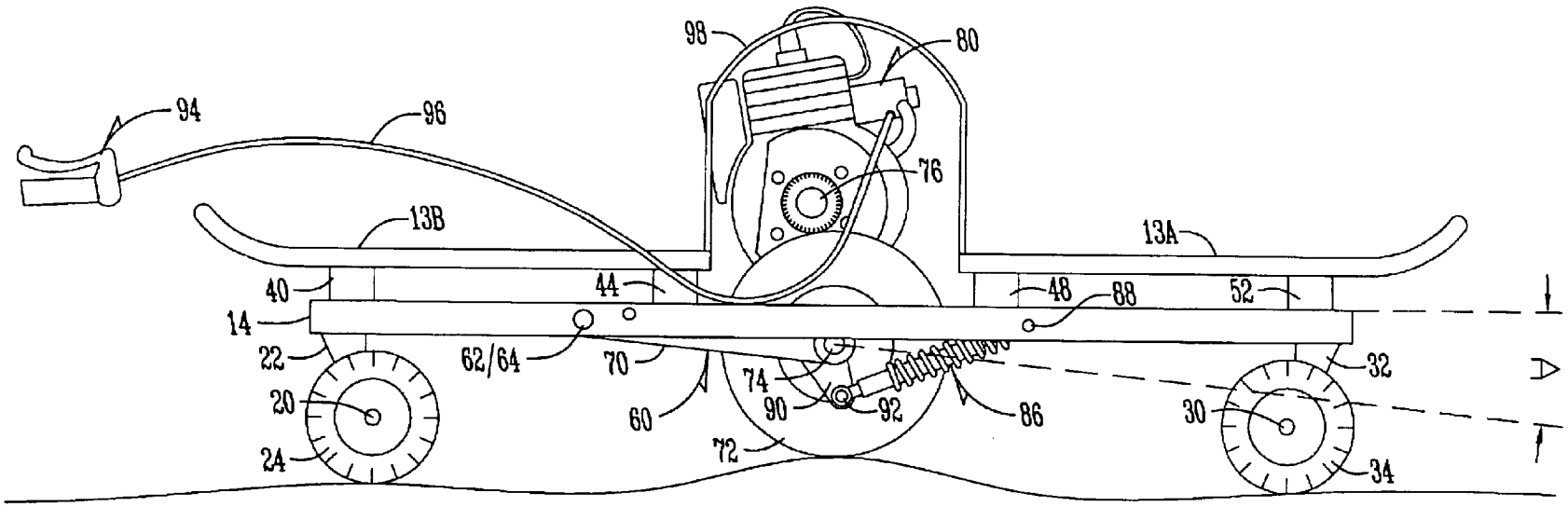
FIG. 4 is similar to FIG. 1, but illustrating the independent movement of the drive wheel relative to skateboard deck and trucks when experiencing a projection from the ground.

As skateboard 10 proceeds along the ground, even if a bump or projection in the ground or riding surface is experienced, forward skateboard truck wheels 34/36 would ride over the bump. As indicated at FIG. 4, when drive wheel 72 comes to the bump, it would move upward against the biasing force of shock absorber 86, but maintain contact with the ground. The gap between deck sections 13A and 13B and the gap between frame rails 14/16 allows swing arm 60 and drive wheel 72 freedom to travel vertically relative to frame and deck 12/13. Swing arm 60 allows this independent vertical travel but keeps drive wheel 72 centered. The user still has the feel of a regular skateboard because the fore and aft skateboard trucks 32 and 22 still support most of the weight of the user and the skateboard on the ground. Thus, the skateboard will tend not to skip or stall because of the bump, while continuing to give the user the "feel" of a skateboard. As shown in FIG. 4, the angle A between swing arm 60 and frame rails 14/16 is decreased from its normal position in FIG. 1.

Figure 5:
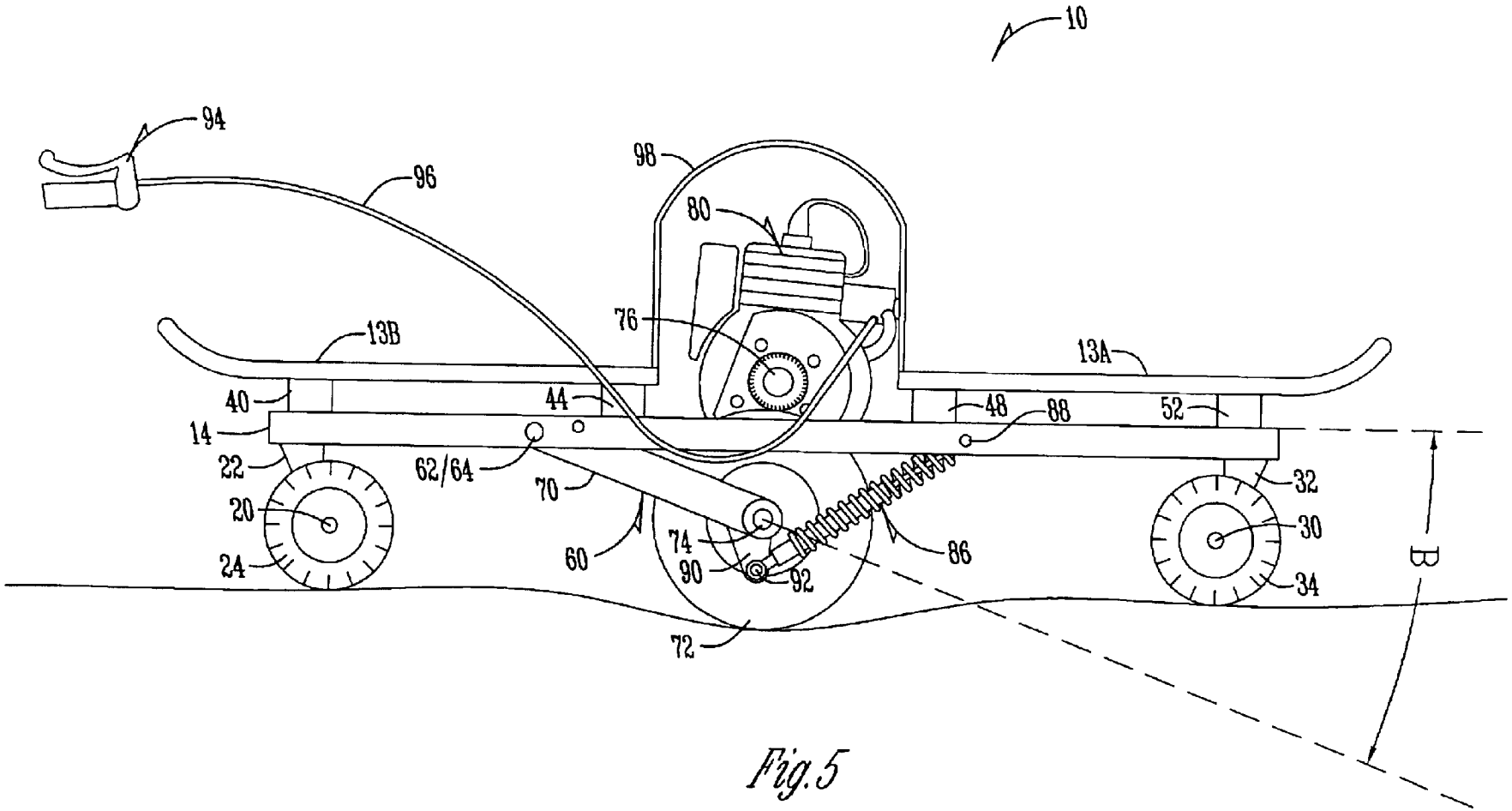
FIG. 5 is similar to FIG. 4 but shows independent movement of drive wheel if it experiences a depression in the ground.

In comparison, as illustrated at FIG. 5, a depression experienced by skateboard 10 still results in drive wheel 72 maintaining contact with the ground. Shock absorber 86 would bias the wheel down into the ground even though the angular position of swing arm 60 relative to frame rails 14 and 16 is much larger (see angle B of FIG. 5) than on a flat surface, or in the situation of FIG. 4 (compare angle A of FIG. 4 with angle B of FIG. 5). Again, the feel of the skateboard remains like a conventional skateboard although there are variations in the ground terrain.

Similarly, if the ground has soft spots or harder spots (e.g. loose dirt versus exposed rocks), drive wheel 72 will always be biased towards engagement for maximum traction.

If the user wants to slow down or stop, throttle is reduced. Because the drive wheel 72 remains in contact with the ground, the back-pressure of the engine will slow the wheel down because of the constant engagement of spindle 76 with drive wheel 72. Eventually when the throttle is reduced enough, there will be insufficient torque to continue to move the skateboard forward. Alternatively, there could be a deadman's switch or other control which would shut the engine off, especially is the user fell and released throttle control 94.

Figure 6:
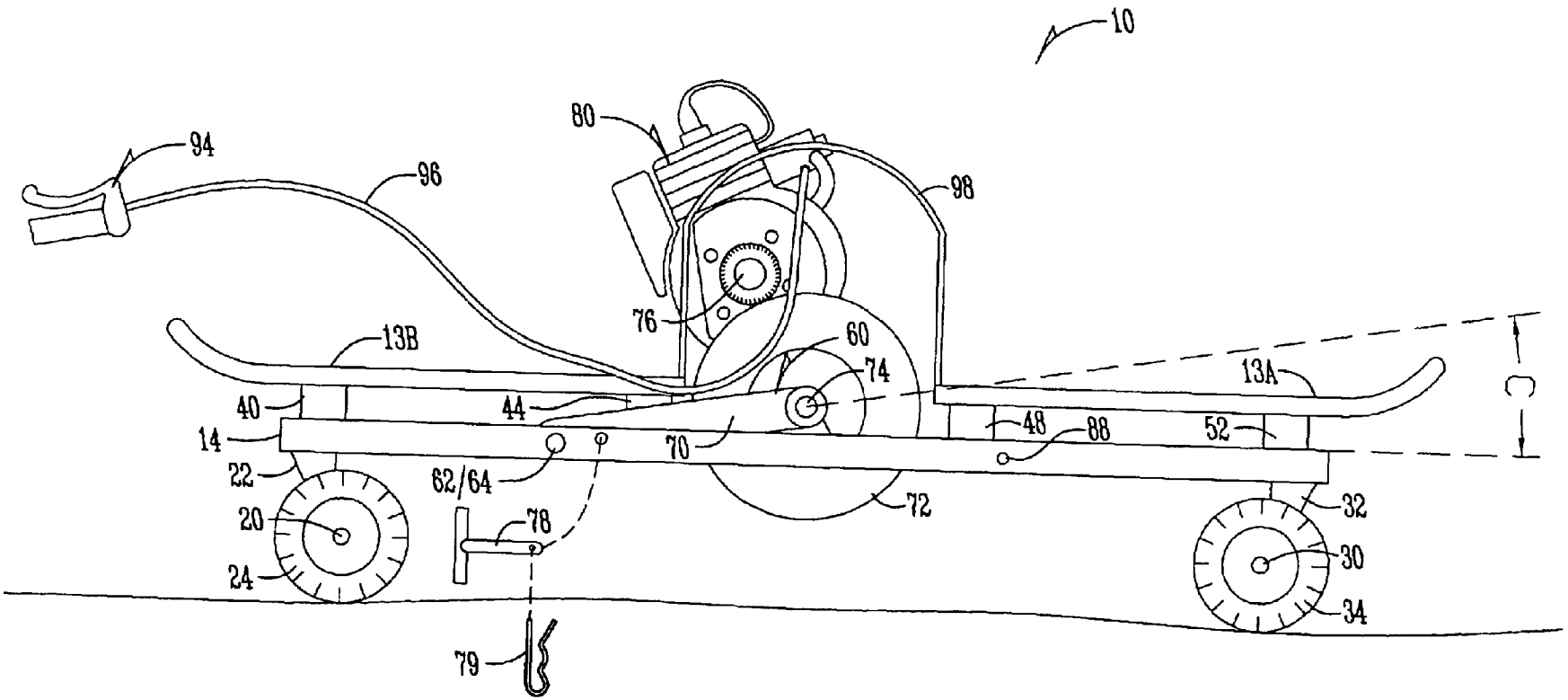
FIG. 6 is similar to FIG. 1 but illustrates how the drive wheel can be locked into an up position such that the skateboard can be used in a non-motorized mode.

FIG. 6 illustrates that skateboard 10 could be used in conventional skateboard mode by placing drive wheel 72 in what will be called a stored position. To do so, the user would grab engine 80, drive wheel 72, and/or swing arm 60 and pull it/them up to the position shown in FIG. 6 (the angle between swing arm 60 and frame rails 14/16 is shown diagrammatically at angle C), with the bottom of drive wheel 72 well above the plane of the bottom of the wheels of skateboard trucks 22 and 32. A pin 78 (or block or other removable or movable member) could pin or secure drive wheel 72 in that up position such that bottom of drive wheel 72 would unlikely touch the ground during operation of skateboard even if there is some variation on the surface of the ground. Pin 78 could extend laterally through aligned apertures in frame rail 14 and arm 70 of swing arm 60, and be locked in place by a cotter pin or key 79, to hold swing arm 60 in the position shown in FIG. 6. Other apparatus or methods could be used to lock swing arm 60 in the stored position so that board 10 could be used in a non-motorized mode.

D. Options and Alternatives

The exemplary embodiment is given by example only and not by limitation to the invention. It will be appreciated that the invention can take many forms of configurations. Variations obvious to those skilled in the art would be included within the scope of the invention, which is defined solely by the claims herein.

For example, as mentioned, instead of having a separate frame and a separate deck, they could be combined. Additionally, engine 80 could be other than gasoline, for example, electric. Still further, the engine 80, whether electric or gasoline powered or otherwise, could potentially be mounted underneath deck 13, if the size and configuration were acceptable.

Still further, other apparatus and methods of rotating drive wheel 72 might be used. There could include some sort of transmission by mechanical linkage or gearing or some differential mechanism as long as there is still allowed independent displacement of drive wheel 72 relative to deck and/or frame.

Motor 80 could include a clutch (such as is well-known) so that instead of having an arrangement where swing arm 60 must be fixed in an up position to disengage the drive wheel from the ground, such a clutch would operate to allow motor 80 to idle without causing rotation of drive wheel 72. It would also allow board 10 to coast down a hill or otherwise be moved along the ground while motor 80 is idling and axle 76 is frictionally engaged with tire 72.

Furthermore, a brake could be added and controlled by the user, for example via a cable and hand control similar to 94 and 96 of FIG. 1. Such a brake could be a caliper brake similar to a bicycle whereby pivotal movement of a brake lever would move a wire in a cable and compress a caliper against the hub or side of wheel 72 to create gripping friction to slow down rotation of wheel 72. Other types of braking systems are possible, of course. One example would be a band brake or other brake on tire 72 and spindle 76 or axle 74.

Different types or methods biasing drive wheel 72 into engagement with the ground are also possible. Essentially, any type of suspension that either biases drive wheel 72 downward, or utilizes the weight of the wheel, swing arm, and/or engine and the like to do so, might be used. In this embodiment, the weight of the engine does assist in the biasing the drive wheel 72 downward.

One example, similar to a normal shock absorber, for biasing drive wheel 72 is shown at FIGS. 7A–C. A stainless steel coil spring 108 having a certain pre-determined length and spring constant can be slid over a set of telescoping stainless steel tubes 106. Set of tubes 106 includes a larger outside diameter tube 110 having a distal end 112 with a threaded or tapped interior and an opposite end 114 that has an inside diameter slightly larger than the outside diameter of tube 116. End 114 of tube 110 can slide over the exterior of end 118 of tube 116. Tube 116 has a distal end 120 with a threaded or tapped interior and an opposite end 118 that slides into end 114 of tube 110. When the assembled set of tubes 106 is inserted inside spring 108, washers 128 and 136 are aligned with the longitudinal axis of the set of tubes 106, and eye bolts 122 and 134, having threaded ends 124 and 132 respectively, are selected such that they are threadably insertable into threaded ends 112 and 120 of tubes 110 and 116 respectively. This combination captures spring 108 between washers 128 and 136, essentially providing end stops for spring 108 in its normal state. Spring 108 and member 106 is then installed between a frame rail 14 and mounting flange 90 (see FIG. 1) by utilizing members 88 and 92 (in this case bolts) which can be inserted through openings in frame rail 14 and flange 90 respectively then through the eye 126 or 134 of eye bolts 122 and 130 respectively, and secured in place by nuts (or other fasteners) 93 and 89 respectively. This combination would result in tension spring 108 biasing washers 128 and 136 outwardly and resisting any force that tries to move them closer together. Once installed, member 106/spring 108 would bias wheel drive wheel 72 downwardly away from rails 14 and 16 to promote consistent contact of drive wheel 72 with the ground. However, any forces experienced by drive wheel tending to move it upwardly towards frame wheels 14 and 16 would be resisted by spring 108. When, those forces exceed the resistance force of spring 108, spring 108 would compress and provide independent movement of tire 72 relative to the rest of skateboard 10. This provides not only the downward biasing force for traction but also shock absorbing force.

In one embodiment, spring 108 is made of steel having a ¼" cross sectional thickness. The inside diameter of the coils of spring 108 is approximately ⅝". The spring can be selected according to design need or desires. For example, a stronger spring could be selected for off-road use, as compared to use on pavement.

Still further, it should be understood that flange 90 could have a plurality of aligned mounting locations for bolt 92, spaced apart such that there would be a selection of distance between mounting of the lower end of members 86 and the upper end of members 86. Alternatively, or in addition, a similar set of aligned connection holes could be formed in frame rail 14 to selectively adjust the connection point of the upper end of member 86 to rail 14. This would allow adjustment in the amount of travel allowed by spring 108 or shock absorber 86 as well as changing the amount of tension or biasing forces. The length of spring 108 in one embodiment is 5 inches when not compressed. It allows a travel of several inches. By allowing adjustment of the distance between bolts 88 and 92, the ride could be stiffer or less stiff, or the amount of travel out could be adjusted. The eye bolts 122 and 134 with washers 128 and 136 effectively function as bearings along with bolts 88 and 92.

It is to be further understood that although most of the weight of the skateboard 10 and the user are supported by the wheels of the skateboard trucks 22 and 32, some support is gained through drive wheel 72. As can be appreciated, having the drive wheel 72 centered on skateboard 10, and having the downward bias, does allow some ability for the user to more quickly and compactly turn skateboard 10 during operation. It has been found that this configuration can allow a shorter turning radius for the skateboard, by providing essentially somewhat of a pivot support in the middle of board 10, which can be added advantageous function.

Types of materials, dimensions, and relative cooperation of the dimensions and components of board 10 can vary according to need and desire.

The embodiment of FIG. 1 can weigh on the order of 35 to 40 pounds. It is contemplated, and believed preferred, to try to reduce the weight as much as possible. It is contemplated that by selection of components, and perhaps combining frame rails 14 and 16 with deck 13, and other methods, the weight could be further reduced while maintaining sufficient strength to support a rider and withstand the rigors of skateboarding, including off-road travel.

What is claimed is:

1. A vehicle comprising:

(a) a skateboard comprising (i) a platform defining generally a first plane and (ii) front and rear trucks, each truck comprising at least one rotatable wheel, the bottom of the wheels of the trucks generally defining a second plane spaced apart from and below the first plane;

(b) a drive wheel mounted to the skateboard by an arm, the arm having one portion mounted to the skateboard and extending to an end to which the drive wheel is rotatably mounted, the drive wheel having a diameter this is at least on the order of the distance between the first and second planes;

(c) an opening in the platform generally aligned with a third plane which is generally orthogonal to the first and second planes, the opening between the first and second trucks and adapted to allow passage of at least a portion of the drive wheel;

(d) a biasing member connected between the skateboard and the arm to bias the arm and the drive wheel away from the skateboard but allowing a range of travel generally in the third plane towards and away from the skateboard, the range of travel comprising a first position wherein a portion of the drive wheel passes into the opening in the platform and the bottom of the drive wheel is above the second plane and nearer the first plane, to a second position wherein the drive wheel is substantially or completely below the opening and the bottom of the drive wheel is below the second plane;

(e) a motor operatively connected to rotate the drive wheel.

2. The vehicle of claim 1 wherein the platform comprises a skateboard deck.

3. The vehicle of claim 1 wherein the arm is a swing arm.

4. The vehicle of claim 1 wherein the motor is gasoline powered.

5. The vehicle of claim 1 wherein the motor is electrically powered.

6. The vehicle of claim 1 wherein the motor is mounted on the arm.

7. The vehicle of claim 1 wherein the drive wheel is biased toward a position away from the platform.

8. The vehicle of claim 1 wherein the drive wheel is driven by frictional engagement with a spindle of the motor.

9. The vehicle of claim 1 wherein the platform comprises a deck for standing by user and a sub-frame underneath the deck.

10. A motorized vehicle comprising:

(a) a skateboard comprising a platform with a deck for standing generally defining a first plane, and a pair of trucks at opposite ends, each truck comprising at least one rotatable wheel, the bottom of the wheels of the trucks generally defining a second plane spaced apart from and below the first plane;

(b) a drive wheel positioned intermediate said trucks and suspended relative to the platform, the drive wheel having a diameter this at least on the order of the distance between the first and second planes;

(c) an opening in the platform generally aligned with a third plane which is generally orthogonal to the first and second planes, the opening between the first and second trucks and adapted to allow passage of at least a portion of the drive wheel;

(d) a suspension supporting the drive wheel, but allowing a range of movement of the drive wheel between a position towards and a position away from the platforms. the range of movement comprising a first position wherein a portion of the drive wheel passes into the opening in the platform and the bottom of the drive wheel is above the second plane and nearer the first plane to a second position wherein the drive wheel is substantially or completely below the opening and the bottom of the drive wheel is below the second plane.

11. The motorized vehicle of claim 10 wherein the platform comprises said deck and a sub-frame.

12. The motorized vehicle of claim 10 wherein the trucks have at least one wheel.

13. The motorized vehicle of claim 10 wherein at least one wheel is pneumatic.

14. The motorized vehicle of claim 10 further comprising a motor mounted on the platform.

15. The motorized vehicle of claim 10 wherein the motor has a rotational output adapted to drive the drive wheel.

16. The motorized vehicle of claim 10 wherein the rotational output frictionally engages the drive wheel.

17. The motorized vehicle of claim 10 wherein the suspension comprises a frame which is moveable relative to the platform.

18. The motorized vehicle of claim 10 wherein the frame is a swing arm having a proximal end pivotally attached to the platform and the wheel rotatably mounted in the swing arm away from the pivotal connection.

19. The motorized vehicle of claim 18 further comprising a biasing member connected between the platform and the swing arm to bias the swing arm away from the platform.

20. A motorized skateboard comprising:

(a) a deck generally defining a first plane, front and rear trucks mourned to the deck, each truck comprising at least one rotatable wheel, the bottom of the wheels of the trucks generally defining a second plane spaced apart from and below the first plane;

(b) a suspension operatively mounted to deck;

(c) a drive wheel operatively mounted in the suspension, the drive wheel having a diameter this is at least on the order of the distance between the first and second planes;

(d) an opening in the platform generally aligned with a third plane which is generally orthogonal to the first and second planes, the opening between the first and second trucks and adapted to allow passage of at least a portion of the drive wheel;

(e) the suspension allowing a range of movement of the wheel relative to the deck, the range of movement comprising a first position wherein a portion of the drive wheel passes into the opening in the platform and the bottom of the drive wheel is above the second plane and nearer the first plane, to a second position wherein the drive wheel is below the second plane; and (f) a motor operatively connected to the drive wheel.

21. The skateboard of claim 20 wherein the deck is elongated along the longitudinal axis.

22. The skateboard of claim 20 wherein the deck comprises a top surface for standing by user.

23. The skateboard of claim 20 wherein the deck further comprises a frame.

24. The skateboard of claim 20 wherein the suspension comprises a supporting member for the drive wheel, the supporting member is moveable relative to the deck.

25. The motorized skateboard of claim 24 further comprising a motor mounted on the supporting member.

26. The motorized skateboard of claim 25 further comprising a biasing member between the deck and the supporting member.

27. The motorized skateboard of claim 26 wherein the biasing member comprises a tension spring.

28. The motorized skateboard of claim 20 further comprising a hand-held throttle control operatively connected to the motor.

29. The motorized skateboard of claim 20 further comprising a deadman's switch on a hand-held throttle control connected to the motor.

* * * * *

UNITED STATES PATENT AND TRADEMARK OFFICE

CERTIFICATE OF CORRECTION

PATENT NO. : 6,848,527 B2
DATED : February 1, 2005
INVENTOR(S) : Nelson, Lukas J.

It is certified that error appears in the above-identified patent and that said Letters Patent is hereby corrected as shown below:

Column 10,
Line 25, replace “forms.” with -- form, --
Line 56, replace “mourned” with -- mounted --

Column 11,
Line 10, after “is” insert -- substantially or completely below the opening and the bottom of the drive wheel --

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,848,527 B2
DATED : February 1, 2005
INVENTOR(S) : Nelson, Lukas J.

It is certified that error appears in the above-identified patent and that said Letters Patent is hereby corrected as shown below:

Title page,
Item [76], Inventor, should be -- Lukas J. Nelson, 704 S. Story St., --

Signed and Sealed this

Twelfth Day of July, 2005

JON W. DUDAS
*Director of the United States Patent and Trademark Office*